US005715769A

United States Patent [19]

Mills

[11] Patent Number: 5,715,769

[45] Date of Patent: Feb. 10, 1998

[54] SIMULATED BOAT FENDER WITH AN INTERNAL STORAGE AREA

[76] Inventor: Russell Mills, 178 Lake Dr., Palm Beach Shores, Fla. 33404

[21] Appl. No.: 719,414

[22] Filed: Sep. 24, 1996

[51] Int. Cl.[6] ..... B63B 59/02

[52] U.S. Cl. ..... 114/220

[58] Field of Search ..... 114/219, 220, 114/343, 270; 220/284, 288, 60

[56] References Cited

U.S. PATENT DOCUMENTS

| | | | |
|---|---|---|---|
| D. 268,469 | 4/1983 | Ruxton | D7/77 |
| D. 276,285 | 11/1984 | Tober | D3/30.1 |
| D. 307,693 | 5/1990 | Rezman | D7/608 |
| D. 369,723 | 5/1996 | McArthur | D7/608 |
| 1,431,911 | 10/1922 | Jones . | |
| 3,145,686 | 8/1964 | Blythe | 114/219 |
| 3,292,566 | 12/1966 | Russell | 114/219 |
| 3,529,744 | 9/1970 | Johnson et al. | 220/60 |
| 3,918,582 | 11/1975 | Wallace | 206/362 |
| 4,228,758 | 10/1980 | Dornau et al. | 114/219 |
| 4,252,073 | 2/1981 | Hartung | 114/219 |
| 4,399,926 | 8/1983 | Eidels-Dubovoy | 220/288 |
| 4,558,796 | 12/1985 | Jaicks | 220/288 |
| 4,708,258 | 11/1987 | Shaw et al. | 220/284 |
| 4,924,796 | 5/1990 | Duffy | 114/219 |
| 5,016,554 | 5/1991 | Harris et al. | 114/219 |
| 5,102,360 | 4/1992 | Eycleshimer | 441/80 |

*Primary Examiner*—Jesus D. Sotelo
*Attorney, Agent, or Firm*—Tom Hamill, Jr.

[57] ABSTRACT

A generally cylindrical simulated boat fender or bumper is provided that has an approximate width to length ratio of 1:3 to allow the device to be used in combination with an existing fender holder or holders mounted on a marine vessel. The device is preferably constructed from a molded polyethylene and has a removable lid. In the preferred embodiment-the lid attachment is of the bayonet type and has a pair of recessed apertures to receive the fingers of the user, but other types of attachment and handle means are discussed. To aid in simulating the appearance of a standard fender or bumper, the device includes a plurality of longitudinally disposed protruding ribs along its outer body, has a smooth rounded base distal the lid and opening, and may include a deep recess or recesses proximate the central longitudinal axis of the apparatus to counterfeit the rope holes on the authentic item.

4 Claims, 3 Drawing Sheets

SIMULATED BOAT FENDER WITH AN INTERNAL STORAGE AREA

BACKGROUND OF THE INVENTION

1. Field of the Invention

The present invention relates generally to containers. More specifically, it relates to a container for rope that additionally simulates a boat fender. Even more specifically, it relates to a combination rope container and simulated boat fender that is dimensioned and configured to easily fit in the existing fender holders that are located proximate the periphery of the boat deck; and more particularly to an improved and novel configuration that provides both convenient storage for various items and easy access to the items contained therein.

2. Description of the Prior Art

Various forms of boat fenders are known in the yachting art. The idea of using boat fenders as containers for items has also been practiced, as will be discussed further hereinbelow. The present invention, however, discloses a novel construction for a simulated boat fender that includes an internal storage compartment for line, and is an improvement on existing boat fenders having internal compartments, in that the dimensions used are chosen such that the instant device is capable of being easily stored in the preexisting fender holder or holders disposed about the periphery of the deck, thus providing shelter for the items contained therein when the actual fenders are either (1) in use or (2) when the vessel is at sea and the fenders themselves can be stowed below. In either case, an attractive appearance is maintained and the possibility of damage by the elements in reduced.

A search conducted at the United States Patent and Trademark Office found a number of related patents, and they are discussed further hereinbelow:

Firstly, U.S. Pat. No. 1,431,911 issued on Oct. 10, 1922 to Harry W. Jones discloses a top or closure for a container. This closure is designed to fit within the open end of the body of the container. Contrast this to the present invention in where the lid is described as preferably not extending within the interior portion of the device to maximize space. Additionally, the protective longitudinally extending and protruding outer ribs seen in the instant invention are not taught in the Jones patent.

In U.S. Pat. No. 3,529,744 issued on Sep. 27, 1970 to Philip P. Johnson there is disclosed a closure with an integral handle. This is clearly unlike the present invention in that specifics of container structure as are necessary for the practice of the instant invention are not disclosed: i.e. the rounded edges of the container end distal the container opening and the protruding ribs extending down the outer sides.

Another patent of interest is U.S. Pat. No. 3,918,582 issued on Nov. 11, 1975 to Alan D. Wallace. In this patent, a container for soaking and preserving paint brushes and roller covers is discussed. This is dissimilar from the present invention in that though a threaded cap is seen, various protruding pouring handles and wire supports existing within the interior area of the device are also shown. Additionally, note that the protective outer ribs and specificity of dimensional ratio between the width and length of the device as required in the present invention is not taught.

Next is U.S. Pat. No. 4,252,073 issued on Feb. 24, 1981 to Philip F. Hartung. This is a combination boat fender and container, however its structure is clearly unlike the instant invention. A glaring example is that the Hartung device is described as having side walls wherein the present invention needs must be cylindrical.

U.S. Pat. No. Des. 268,469 issued on Apr. 5, 1983 to Craig Ruxton, et al. discloses a beverage container. Though the outward appearance of the device is superficially similar, its various sharp edges and handles would preclude its use as a floating protective device.

In U.S. Pat. No. 4,399,926 issued on Aug. 23, 1983 to Samuel Eidels-Dubovoy there is disclosed a resealable container. As in the Wallace patent above, a threaded top and cylindrical shape is described, however the ratio between diameter and length, the longitudinal protruding ribs, and the rounded edges distal the opening where the threaded top is engaged are not seen.

U.S. Pat. No. 4,410,084 issued on Oct. 18, 1983 to Charles R. Ladner discloses a water ski rope storage compartment. In contrast to the present invention, various internal structures and permanent openings (existing even when the device is "closed") are shown.

U.S. Pat. No. Des. 276,285 issued on Nov. 13, 1984 to Carlyn D. Tober et al. is a storage container. Contrast the inwardly disposed longitudinal depressions to the protruding ribs of the instant invention.

In U.S. Pat. No. 4,558,796 issued on Dec. 17, 1985 to John R. Jaicks there is disclosed an animal proof storage container. Unlike the present invention, there are no protruding ribs disposed on the outward surface.

Next is U.S. Pat. No. 4,708,258 issued on Nov. 24, 1987 to Mark D. Shaw et al. This is a salvage drum, and there is no teaching of any advantage in keeping the ratio between its width and its length within certain boundaries.

Another patent of interest is U.S. Pat. No. 4,875,427 issued on Oct. 24, 1989 to Rano J. Harris, Jr. This describes boat fenders with internal rope storage capacities, however there are clear dissimilarities. The instant invention has a single internal storage chamber, whereas the Harris, Jr. device has two. Additionally, the longitudinal ribs of the instant invention are not described in the Harris, Jr. device.

U.S. Pat. No. Des. 307,693 issued on May 8, 1990 to Mitchell Rezman discloses a portable beverage dispenser. This is clearly dissimilar from the present invention in that the ribs seen in the Rezman patent are circumferential.

Next is U.S. Pat. No. 4,924,796 issued on May 15, 1990 to Keith Duffy. This discloses a replaceable inflation valve that is used in a marine fender. There is no teaching of the dimensional restraints of the present invention that allows it to be used as a simulated boat fender with the existing fender holders.

In U.S. Pat. No. 5,016,1991 issued on May 21, 1991 to Rano J. Harris, Jr. et al. there is disclosed a line storage reel for boat fenders. This is unlike the present invention in that, as in a number of patents mentioned above, there is no teaching of the ratio constraint between the width of the device and the length of the device.

The penultimate patent in this discussion is U.S. Pat. No. 5,102,360 issued on Apr. 7, 1992 to Robert G. Eycleshimer. This discloses a container adapted for shipboard use, specifically for survival equipment. This is unlike the present invention in many respects, one of which is that the cap construction includes a bolt for a rope tether. The present invention contemplates recesses for the fingers to facilitate the removal and attachment of the lid.

Lastly, U.S. Pat. No. Des. 369,723 issued on May 14, 1996 to Brenda A. McArthur et al. discloses an insulated food container. This is unlike the present invention in that no longitudinal protruding ribs are seen, and the ratio between the width of the unit and its length is seen to be closer to 1:2 than to 1:3 as is needed in the present invention.

Thus, while the foregoing body of prior art indicates it to be well known to use boat fenders as containers for various articles, no simulated boat fenders adapted to be used with the existing fender or bumper holders is seen. The construction of the simulated fender is important: not only does it prevent ambient conditions from damaging the articles contained therein, it also could possibly prevent theft. A miscreant could overlook the equipment contained in what they thought was merely a protective flotation device stored on board the boat. Another advantage to the simulated appearance brought about by the specific construction of the present invention is that children would be less likely to "mess with it", damaging the contents, thinking it was just another boat bumper. These advantages will be stated again in more detail below.

SUMMARY OF THE INVENTION

To achieve the foregoing and other advantages, the present invention, briefly described, provides a generally cylindrical simulated boat fender or bumper that has an approximate width to length ratio of 1:3 to allow the device to be used in combination with an existing fender holder or holders mounted on a marine vessel. The device is preferably constructed from a molded polyethylene and has a removable lid. In the preferred embodiment the lid attachment is of the bayonet type and has a pair of recessed apertures to receive the fingers of the user, but other types of attachment and handle means are discussed. To aid in simulating the appearance of a standard fender or bumper, the device includes a plurality of longitudinally disposed protruding ribs along its outer body, has a smooth rounded base distal the lid and opening, and may include a deep recess or recesses proximate the central longitudinal axis of the apparatus to counterfeit the rope holes on the authentic item..

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining the preferred embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved simulated boat fender with internal rope storage which has all of the advantages of the prior art and none of the disadvantages.

It is another object of the present invention to provide a new an improved simulated boat fender with internal rope storage which may be easily and efficiently manufactured and marketed.

It is a further objective of the present invention to provide a new and improved simulated boat fender with internal rope storage which is of durable and reliable construction.

An even further object of the present invention is to provide a new and improved simulated boat fender with internal rope storage which is susceptible of a low cost of manufacture with regard to both materials and labor, and which accordingly is then susceptible of low prices of sale to the consuming public, thereby making such a simulated boat fender with internal rope storage available to the buying public.

Still yet a further object of the present invention is to provide a new and improved simulated boat fender with internal rope storage wherein the ratio of the width to the length of the device is approximately 1:3 so that it can be used with existing boat fender racks or holders present on a marine vessel.

It is still a further object of the present invention is to provide a new and improved simulated boat fender with internal rope storage wherein the internal storage compartment is accessed by an easily removable and resealable lid.

Still a further object of the present invention is to provide a new and improved simulated boat fender with internal rope storage including means for simulating the appearance of existing boat fenders in that a plurality of longitudinal protruding ribs run along the outer main surface of the body of the apparatus and the base, or end distal from the opening and its accompanying lid has rounded edges and a smooth surface, both of these features being of necessary import in the structure of an actual boat fender or bumper.

Still yet another object of the invention is to provide a simulated boat fender with internal rope storage wherein the handle means to remove and replace the lid of the device is a pair of recessed apertures that allow the users fingers, thumbs, and the like to be used in manipulating the lid.

Still yet another object of the invention is to provide a simulated boat fender with internal rope storage wherein a deep recess or recesses are located at the end or ends of the apparatus, proximate its central longitudinal axis, to counterfeit the rope holes of an actual fender.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DETAILED DESCRIPTION OF THE PREFERRED EMBODIMENT

With reference now to the drawings, a new and improved simulated boat fender with internal rope storage embodying the principles and concepts of the present invention will be described.

Figure 1:
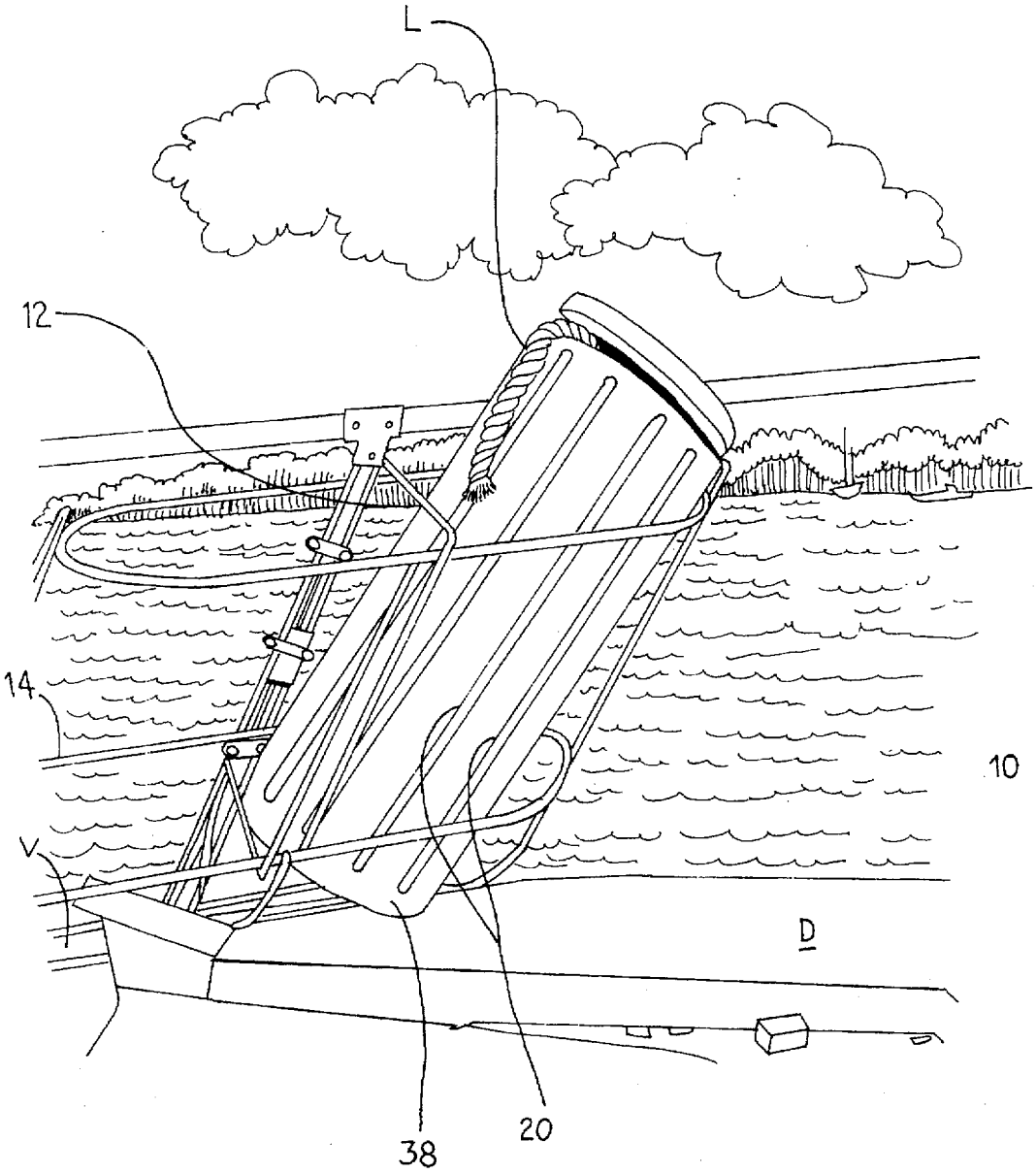
FIG. 1 is an environmental perspective view of one of the present invention apparatus placed in an existing fender or bumper holder.

Turning initially to FIG. 1, the present invention is indicated at 10. As it can be seen, the simulated boat fender is placed within the existing rack 12 mounted on the marine vessel V. Please note that these existing racks 12 are well known and easily available. They are usually placed proximate the periphery of the deck D of vessel V, as seen in FIG. 1. In this Figure, the bow (not shown) of the vessel V is closest to the point indicated at 14 in the Figure. As it can be seen, the present invention 10 fits well into the existing rack 12. This is because the existing rack 12 is configured to receive conventional boat fenders or bumpers (not shown); and that these conventional devices are made in standardized and specific sizes. These existing conventional fender sizes are:

| approx. width | approx. length |
|---|---|
| 6" | 16" |
| 8" | 21" |
| 10" | 27" |

Thus, it can be seen that in all these cases, the general ratio between the width to the length is 1:3. The existing boat fender racks are designed to accept these sizes, and so the simulated fenders that comprise the instant invention must reflect these constraints. Also note in FIG. 1, the longitudinally disposed protruding ribs 20 that extend along the outer wall 30 of the simulated fender 10. The ribs 20 will be discussed further below. Additionally, in this Figure, the end of a line L is seen partially removed from the interior storage chamber 28 (seen in FIG. 2).

Figure 2:
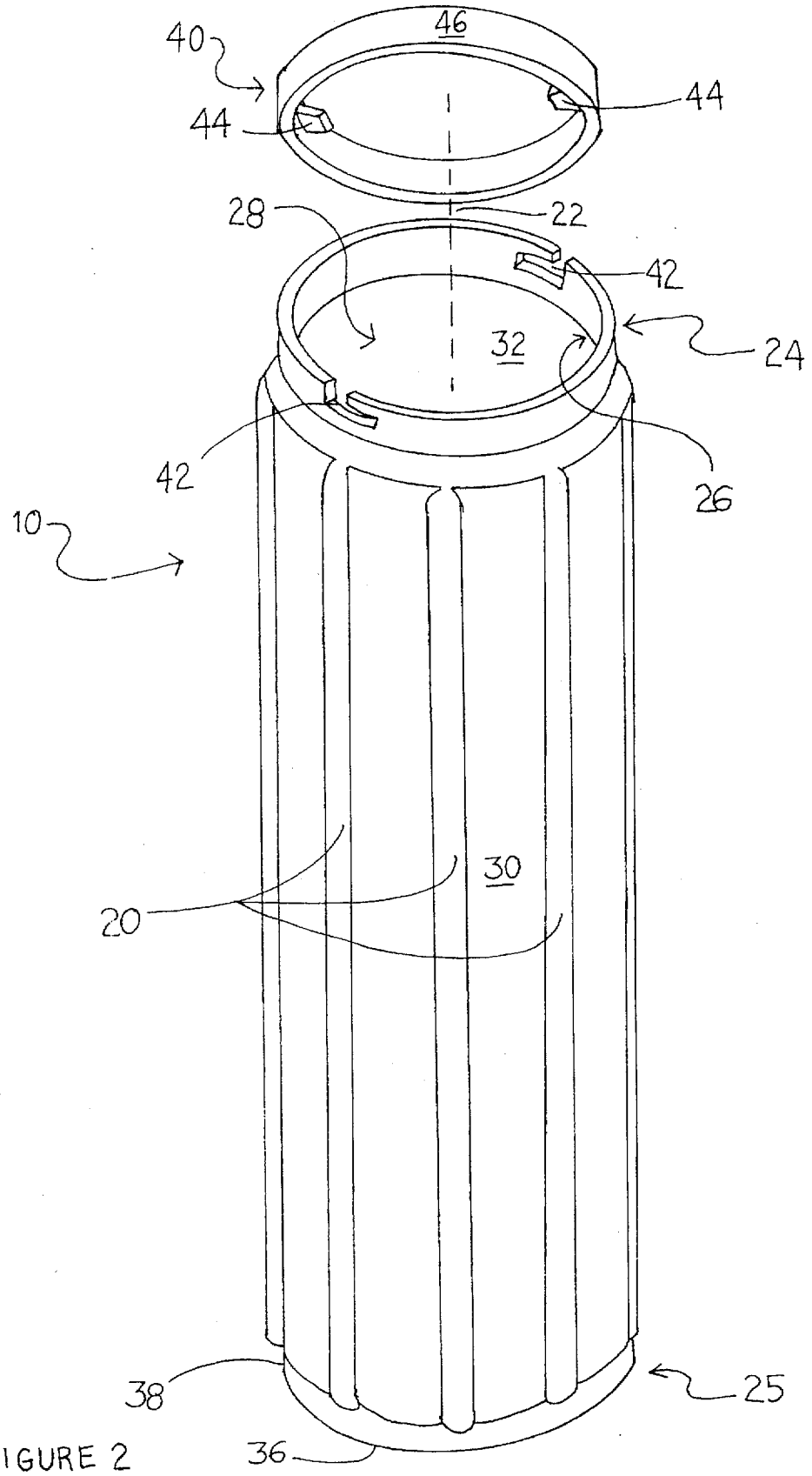
FIG. 2 is an exploded view of the preferred embodiment of the present invention.

Looking for further details, the discussion now turns to FIG. 2. As it can be seen, the simulated fender 10 is generally cylindrical in shape. It has a central longitudinal axis indicated at 22. First end 24 has an opening 26 therein. This opening 26 leads to an interior storage chamber 28. As can be seen, the opening 26 leads to interior wall 32, located slightly closer to central longitudinal axis 22 than outer wall 30 such that the space between them defines a plenum or air space (not shown). This space would allow the simulated fender 10 to be buoyant if it was accidentally or purposefully placed in the water. Distal the first end 24 is second end 25. This includes a generally flat base 36, that allows the simulated boat fender 10 to deposited upright on a planar surface or disposed at an angle in the existing fender rack 12, as seen in FIG. 1. Between the flat base 36 and the outer wall 30 is base edge 38 that is smoothly rounded to simulate the corresponding smoothness in the authentic boat fender or bumper (not shown).

Also seen in FIG. 2 are the longitudinally disposed protruding ribs 20. These ribs are preferably formed from the outer wall 30, are parallel to the central longitudinal axis 22, and extend away therefrom. Forming the ribs 20 from the material of the outer wall 30 allows the device 10 to molded from polyethylene or some other thermoplastic material. It should be emphasized the mention of a specific substance as an example of a material that the present invention could be made from should in no way be construed as a limiting factor in the practice of the invention. The skilled artisan could use many other materials that came to hand, and these various materials are omitted in this specification for the sake of brevity and clarity. Both the ribs 20 and the base 36, with its smoothly rounded base edge 38, are necessary for the proper practice of the present invention. As mentioned previously, one of the points or objects of the invention is to simulate the appearance of existing boat fenders, and the ribs and rounded edges are elements that are important in the functionality of the existing fenders. The ribs of these existing devices are designed to absorb shocks and the rounded edges prevent scratching if the vessel is berthed to a wharf, dock, or other vessel. The functionality of these elements in the present invention is that they counterfeit the presence of the corresponding elements in the existing, or authentic, boat fenders. This could prevent theft, as mentioned above, if a miscreant should choose to come aboard while the vessel was unattended. The simulated fenders would be mistaken for authentic fenders and would not be tampered with. Also, when the vessel is moored, the presence of the devices 10 in the existing racks 12 presents a smart appearance. Another advantage of the simulated fenders 10 is that small children or other types of "lubbers" would be inclined to leave them alone, regarding them as uninteresting, thus providing protection for the lines (or other ship's stores) contained therein. Thus the present invention provides a convenient place to store the lines or ship's stores while the vessel is under way, where the stores are at hand, mounted securely in the existing racks 12.

The storage capacity of the present invention is maximized by virtue of the small space or plenum between the outer wall 30 and the interior wall 32. Also, the opening 26 is made to be as wide as is possible, thus allowing easy access to the coiled line L (not seen FIG. 2) contained within storage chamber 28.

The discussion now turns to the attachment means between the lid 40 and the opening 26 of the simulated fender 10. It is contemplated in the preferred embodiment that a bayonet type attachment means could be used. These well known types of attachments will not be explained in detail, comprising a slotted engagement means 42 on the outer portion of the opening 26 with the corresponding protrusions 44 on the lid 40. The lid 40 has a downwardly depending lip 46 that holds these protrusions 44. Other types of engagement means would occur to any skilled artisan, such as threaded types with varying degrees of pitch, simple frictional engagement, or hinges of various types, such as a living hinge. The major consideration in the type of engagement used is that it prevent, when the lid is in place, fluid communication between the interior storage chamber 28 and the ambient air, thus protecting whatever contents are placed within the simulated fender 10.

Figure 3:
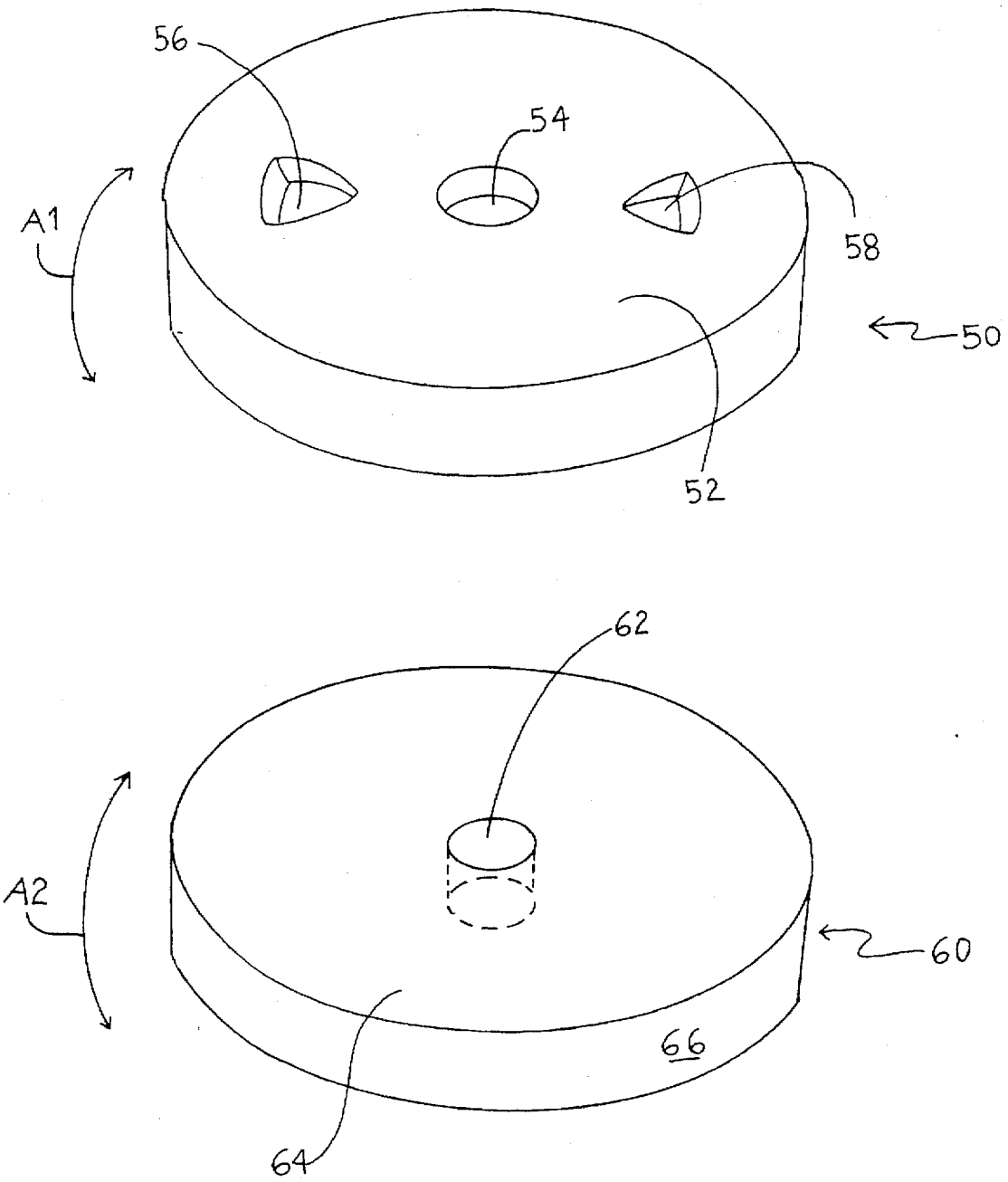
FIG. 3 is a perspective view of two contemplated lid types that would conform to various embodiments of the present invention.

The discussion now turns to the handle means used to engage and disengage the lid 40 from the opening 26 of the simulated fender 10. Two contemplated lid types are seen in FIG. 3. It should be mentioned that the preferred height of the lids discussed herein would be about 1½ inches. This height is included in the overall height of the simulated fender and should be taken into account when considering the 1:3 width to height ratio.

The first lid embodiment is indicated at 50. Located proximate the center of the top portion 52 of the lid 50 is a small recess 54. This recess is provided to simulate the rope hole or aperture that extends through the existing boat fenders that the present invention simulates. This recess 54 is also located proximate the central longitudinal axis 22 of the simulated fender 10. Located opposite to one another on either side of recess 54 are finger apertures 56, 58. These are roughly triangular in shape and extend deeply enough that the user can manipulate the lid 50 in either direction as indicated by directional arrow A1.

The second lid embodiment is indicated at 60 in FIG. 3. In this embodiment, the lid is provided with a single recessed aperture 62. This aperture is molded or formed more deeply than those discussed above, but it is located centrally in the top portion 64 of this contemplated lid 60. The recess 62 of this embodiment also fulfills the purpose of simulating the rope aperture present in the existing boat fenders or bumpers and, as in recess 54 above, is located proximate to the central longitudinal axis of the simulated fender 10. The user would manipulate this handle by placing his or her thumb in the recess 62 and engaging the peripheral wall 66 of lid 60 would rotate lid 60 in either direction as indicated by directional arrow A2.

It is apparent from the above that the present invention accomplishes all of the objectives set forth by providing a new and improved simulated boat fender with internal rope storage that is configured to fit into the existing racks already mounted on many vessels currently in use.

With respect to the above description, it should be realized that the optimum dimensional relationships for the parts of the invention, to include variations in size (to the degree discussed in the claims), materials, shape, form, function and manner of operation, assembly and use, are deemed readily apparent and obvious to those skilled in the art, and therefore, all relationships equivalent to those illustrated in the drawings and described in the specification are intended to be encompassed only by the scope of the appended claims.

While the present invention has been shown in the drawings and fully described above with particularity and detail in connection with what is presently deemed to be the most practical and preferred embodiment of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by LETTERS PATENT of the United States is as follows:

1. An apparatus for simulating a boat fender for use in a marine vessel having existing fender racks comprising:

a generally cylindrical main body portion having a first end and a second end, said first end including a removable lid portion, where said removable lid portion includes a peripheral wall, and said second end including a generally flat base portion, and where said first end also includes an opening, said first end opening defining an interior storage chamber within said cylindrical body portion;

said generally cylindrical main body portion having a width and a length, and including a central longitudinal axis, and where a ratio exists between body portion width and said body portion length, where said ratio is 1:3 width to length and where said 1:3 ratio has a tolerance of 15%;

said generally cylindrical main body portion has an outer wall extending thereabouts, said outer wall including a plurality of longitudinal ribs protruding outwardly from, and parallel to, said central longitudinal axis of said generally cylindrical main body portion;

a smoothly rounded base edge located proximate to and between both said cylindrical body outer wall and said cylindrical body flat base portion; and when said removable lid portion is engaged to said generally cylindrical main body portion, said peripheral wall of said removable lid portion is substantially coextensive in relation with said outer wall of said generally cylindrical main body portion: whereby said simulated boat fender is adapted to fit within an existing fender rack on a marine vessel, and where items may be stored within said interior storage chamber.

2. The apparatus for simulating a boat fender as claimed in claim 1, wherein said removable lid portion includes attachment means for attachment to said opening in said cylindrical main body and where said attachment means is a bayonet type engagement.

3. An apparatus for simulating a boat fender for use in a marine vessel having existing fender racks comprising:

a generally cylindrical main body portion having a first end and a second end, said first end including a removable lid portion, and said second end including a generally flat base portion, and where said first end also includes an opening, said first end opening defining an interior storage chamber within said cylindrical body portion;

said generally cylindrical main body portion having a width and a length, and including a central longitudinal axis, and where a ratio exists between body portion width and said body portion length, where said ratio is 1:3 width to length and where said 1:3 ratio has a tolerance of 15%;

said generally cylindrical main body portion has an outer wall extending thereabouts, said outer wall including a plurality of longitudinal ribs protruding outwardly from, and parallel to, said central longitudinal axis of said generally cylindrical main body portion;

a smoothly rounded base edge located proximate to and between both said cylindrical body outer wall and said cylindrical body flat base portion; and said removable lid portion has a height and includes a generally flat top portion distal to said interior storage chamber when said removable lid portion is engaged with said cylindrical body portion, and said removable lid portion further includes handle means, said handle means comprising a centrally disposed recess in said generally flat top portion of removable lid portion, said recess being proximate said central longitudinal axis of said cylindrical body portion when said removable lid portion is engaged with said cylindrical body portion, and where said centrally disposed recess extends less than ½ said height of said removable lid portion, and a pair of finger recesses in said flat top portion of said removable lid portion, said pair of finger recesses being located opposite to one another in respect to said centrally disposed recess: whereby said simulated boat fender is adapted to fit within an existing fender rack on a marine vessel, and where items may be stored within said interior storage chamber.

4. An apparatus for simulating a boat fender for use in a marine vessel having existing fender racks comprising:

a generally cylindrical main body portion having a first end and a second end, said first end including a removable lid portion, and said second end including a generally flat base portion, and where said first end also includes an opening, said first end opening defining an interior storage chamber within said cylindrical body portion;

said generally cylindrical main body portion having a width and a length, and including a central longitudinal axis, and where a ratio exists between body portion width and said body portion length, where said ratio is 1:3 width to length and where said 1:3 ratio has a tolerance of 15%;

said generally cylindrical main body portion has an outer wall extending thereabouts, said outer wall including a plurality of longitudinal ribs protruding outwardly from, and parallel to, said central longitudinal axis of said generally cylindrical main body portion;

a smoothly rounded base edge located proximate to and between both said cylindrical body outer wall and said cylindrical body flat base portion; and said removable lid portion has a height and includes a generally flat top portion distal to said interior storage chamber when said removable lid portion is engaged with said cylindrical body portion, and said removable lid portion further includes handle means, said handle means comprising a centrally disposed recess in said generally flat top portion of removable lid portion, said recess being proximate said central longitudinal axis of said cylindrical body portion when said removable lid portion is engaged with said cylindrical body portion, and where said centrally disposed recess extends more than ½ of said height of said removable lid portion: whereby said simulated boat fender is adapted to fit within an existing fender rack on a marine vessel, and where items may be stored within said interior storage chamber.

* * * * *